US010490175B2

(12) United States Patent
Oshiro

(10) Patent No.: US 10,490,175 B2
(45) Date of Patent: Nov. 26, 2019

(54) AUDIO DEVICE AND ELECTRONIC INSTRUMENT

(71) Applicant: CASIO COMPUTER CO., LTD., Shibuya-ku, Tokyo (JP)

(72) Inventor: Atsushi Oshiro, Fussa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 16/231,526

(22) Filed: Dec. 23, 2018

(65) Prior Publication Data

US 2019/0198000 A1 Jun. 27, 2019

(30) Foreign Application Priority Data

Dec. 27, 2017 (JP) ..... 2017-251039

(51) Int. Cl.

| | |
|---|---|
| ***G10H 1/32*** | (2006.01) |
| ***G10C 3/02*** | (2006.01) |
| ***G10K 15/08*** | (2006.01) |
| ***G10C 3/12*** | (2006.01) |

(52) U.S. Cl.

CPC ..... *G10H 1/32* (2013.01); *G10C 3/02* (2013.01); *G10C 3/12* (2013.01); *G10K 15/08* (2013.01); *G10H 2210/325* (2013.01)

(58) Field of Classification Search

CPC ..... G10H 1/32
USPC ..... 84/644, 670, 718, 719, 743, 744
See application file for complete search history.

(56) References Cited

U.S. PATENT DOCUMENTS 1,893,893 A * 1/1933 Hammond, Jr. ..... G10C 3/06 181/141
2,949,053 A * 8/1960 Andersen ..... G10D 13/085 84/351
2,952,179 A * 9/1960 Andersen ..... G10H 3/20 181/141
3,391,241 A * 7/1968 Andersen ..... H04R 1/2819 84/354
3,643,000 A * 2/1972 Andersen ..... G10H 1/0091 84/600
4,058,045 A * 11/1977 Jennings ..... G10C 3/00 84/731

(Continued)

FOREIGN PATENT DOCUMENTS

JP H03044992 U 4/1991
JP H05241574 A 9/1993

(Continued)

*Primary Examiner* — David S Warren
(74) *Attorney, Agent, or Firm* — Holtz, Holtz & Volek PC

(57) ABSTRACT

An audio device and an electronic instrument are provided by which a device case can be downsized. An elastic member is interposed between an attachment hole provided in a panel-side sealed frame section of a speaker panel and a projection section of a speaker grill and, in this state, the speaker grill is fixed to the speaker panel by the projection section being subjected to torsion deformation. By the elastic member being deformed inside the attachment hole and coming in close contact with the surface of the projection section and the inner surface of the attachment hole, the attachment hole that is a through hole is filled. As a result of this structure, an attachment hole that is used when a speaker grill is attached to a speaker panel can be arranged at a position where it penetrates to an acoustic space.

12 Claims, 15 Drawing Sheets

(56) References Cited

U.S. PATENT DOCUMENTS 4,084,473 A * 4/1978 Kitashima ..... G10C 3/04 84/173
4,312,258 A * 1/1982 Park ..... G10D 1/085 181/150
4,334,453 A * 6/1982 Kumano ..... G10H 1/32 84/177
5,086,686 A * 2/1992 Misawa ..... G10H 1/0091 181/144
5,248,846 A * 9/1993 Koike ..... G10H 1/0091 84/718
5,335,283 A * 8/1994 Torii ..... G10H 1/0091 181/145
6,392,136 B2 * 5/2002 Kondo ..... G10H 1/32 84/718
6,528,708 B2 * 3/2003 Konishi ..... G10H 1/32 181/198
6,696,633 B2 * 2/2004 Miyagishima ..... G10H 1/0091 381/103
6,916,980 B2 * 7/2005 Ishida ..... G10H 1/32 381/118
6,972,358 B2 * 12/2005 Ishihara ..... G10H 1/32 84/174
7,060,890 B2 * 6/2006 Sato ..... G10H 1/32 84/745
7,078,611 B2 * 7/2006 Izumi ..... G10H 1/32 84/177
7,119,269 B2 * 10/2006 Furuhashi ..... G10H 1/32 84/744
7,332,669 B2 * 2/2008 Shadd ..... G10H 3/146 84/645
7,348,477 B2 * 3/2008 Ishihara ..... G10H 1/32 84/177
7,425,672 B2 * 9/2008 Haba ..... G10H 1/32 84/177
7,692,089 B2 * 4/2010 Nishida ..... G10H 1/32 84/644
7,804,017 B2 * 9/2010 Hata ..... G10H 1/32 84/644
8,039,725 B2 * 10/2011 Kato ..... G10H 1/32 84/177
8,066,095 B1 * 11/2011 Bromer ..... H04R 1/2857 181/148
8,130,495 B2 * 3/2012 Field ..... G10H 1/32 361/694
8,193,438 B2 * 6/2012 Hoshino ..... H04R 5/02 84/644
8,426,713 B1 * 4/2013 Sardo ..... G10H 1/344 84/423 R
9,012,758 B2 * 4/2015 El-Khadem ..... G10H 1/32 84/723
10,304,423 B2 * 5/2019 McAuld ..... G10H 3/18
2001/0052280 A1 * 12/2001 Konishi ..... G10H 1/32 84/277
2001/0052284 A1 * 12/2001 Kondo ..... G10H 1/32 84/718
2003/0051594 A1 * 3/2003 Ishihara ..... G10H 1/32 84/177
2003/0121402 A1 * 7/2003 Yataka ..... G10H 1/0091 84/625
2003/0121403 A1 * 7/2003 Miyagishima ..... G10H 1/0091 84/735
2003/0196541 A1 * 10/2003 Ishida ..... G10H 1/32 84/622
2004/0173086 A1 * 9/2004 Sato ..... G10H 1/32 84/745
2006/0027070 A1 * 2/2006 Ishihara ..... G10H 1/32 84/177
2007/0017343 A1 * 1/2007 Nishida ..... G10C 3/12 84/423 R
2007/0028755 A1 * 2/2007 Suzuki ..... G10H 1/346 84/746
2010/0192756 A1 * 8/2010 Kato ..... G10H 1/32 84/744
2011/0033066 A1 * 2/2011 Siegrist ..... G10H 1/32 381/118
2011/0075359 A1 * 3/2011 Field ..... G10H 1/32 361/695
2013/0047824 A1 * 2/2013 Ludwig ..... G10H 1/32 84/644
2014/0013929 A1 * 1/2014 El-Khadem ..... G10H 3/18 84/726
2018/0218716 A1 * 8/2018 McAuld ..... G10H 3/18

FOREIGN PATENT DOCUMENTS

JP 05080086 U 10/1993
JP H05268687 A 10/1993

* cited by examiner

SECTIONAL VIEW TAKEN ALONG LINE A-A (A-A' CROSS-SECTION)

(B-B' CROSS-SECTION)

DETAILS OF PORTION B

AUDIO DEVICE AND ELECTRONIC INSTRUMENT

CROSS-REFERENCE TO RELATED APPLICATION

This application is based upon and claims the benefit of priority from the prior Japanese Patent Application No. 2017-251.039, filed Dec. 27, 2017, the entire contents of which are incorporated herein by reference.

BACKGROUND OF THE INVENTION

1. Field of the Invention

The present invention relates to an audio device and an electronic instrument.

2. Description of the Related Art

Conventionally, as an audio device such as an electronic instrument and a speaker having a bass reflex structure or a sealing structure, an audio device is known in which an upper case and a lower case are included, a frame shaped upper partition plate that surrounds a side part of an attached speaker is provided in the upper case, a frame shaped lower partition plate that also surrounds the side part of the speaker is provided in the lower case such that it is opposed to the upper partition plate, and the upper partition plate and the lower partition plate constitutes a speaker accommodation section that is a sealed acoustic space, as described in Japanese Patent Application Laid-Open (Kokai) Publication No. 05-241574.

In the audio device of Japanese Patent Application Laid-Open (Kokai) Publication No. 05-241574 which has the structure including the sealed acoustic space (speaker accommodation section), if an attachment hole for a speaker grill (sound hole net body) that protects the sound emission surface (vibration plate) of the speaker is provided penetrating to the acoustic space when the speaker grill is mounted on the outer side of the upper case, the leakage of sound and air occurs from the attachment hole, whereby the sealed state of the acoustic space cannot be maintained. As a result, low pitched sounds cannot be emitted during musical sound emission and the primary characteristics of the bass reflex structure are deteriorated.

As described above, the conventional technique has a problem in that the attachment hole for the speaker grill cannot be formed at a position where it penetrates to the acoustic space, and is required to be provided outside the acoustic space, which impedes the downsizing of electronic instrument cases or audio device cases.

The present invention has an advantageous effect in that an audio device and an electronic instrument whose device or instrument case can be downsized are provided.

SUMMARY OF THE INVENTION

In accordance with one aspect of the present invention, there is provided an audio device comprising: a main body case having an inner wall defining a through hole connected to an acoustic space formed around at least one speaker provided inside the main body case; a cover member having a projection section inserted into the through hole such that a distal end of the projection section projects to the acoustic space side from the through hole; and an elastic member which covers the distal end of the projection section and whose at least one portion is arranged between the inner wall and the projection section in the through hole, wherein at least one portion of the elastic member covering the distal end and at least one portion of the distal end are arranged in a space located outside a space surrounded by an extended line of the inner wall, whereby the cover member is fixed to the main body case.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

BRIEF DESCRIPTION OF THE DRAWINGS

The present invention can be more clearly understood by the detailed description below when considered together with the following drawings.

DETAILED DESCRIPTION OF THE PREFERRED EMBODIMENTS

An embodiment of an audio device and an electronic instrument according to the present invention will hereinafter be described in detail with reference to the drawings. In the present embodiment, an electronic keyboard instrument (electronic keyboard) is described as an example of the audio device and the electronic instrument of the present invention.

<Electronic Keyboard Instrument>

Figure 1:
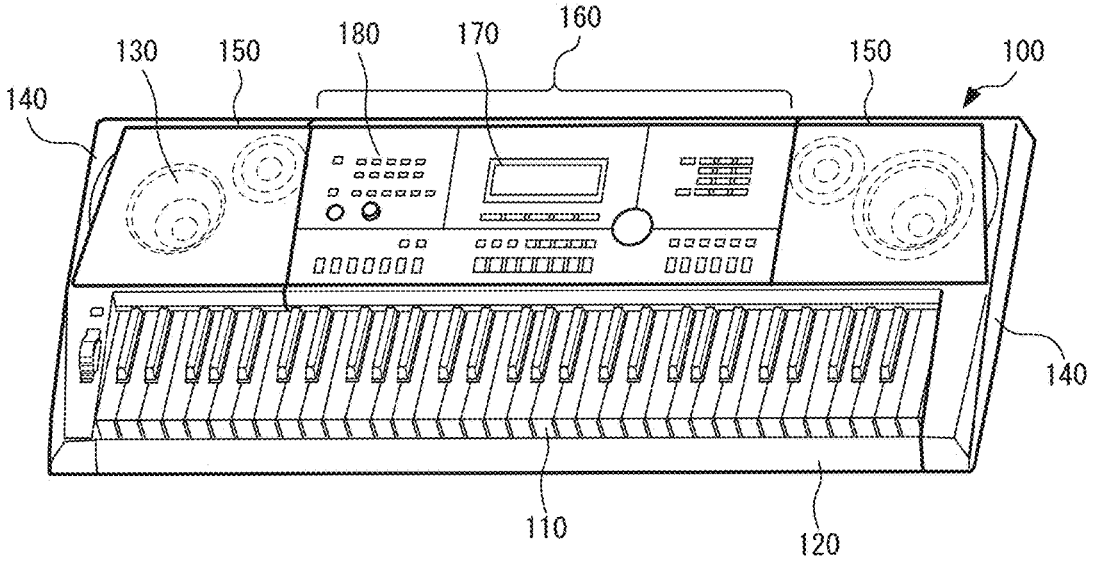
FIG. 1 is an outer appearance view of an electronic keyboard instrument serving as an embodiment of an audio device and an electronic instrument according to the present invention.
Figure 2:
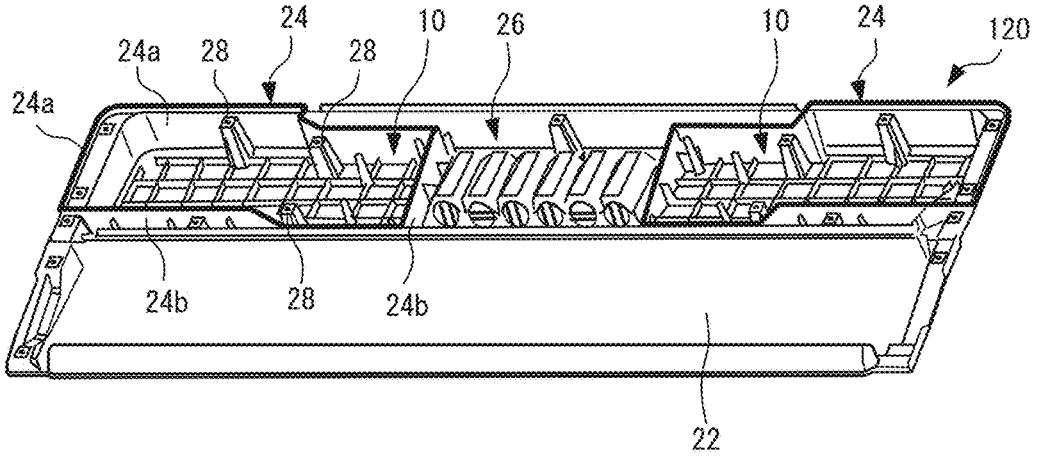
FIG. 2 is a schematic diagram showing an example of a base body case applied to the electronic keyboard instrument according to the embodiment.
Figure 3A:
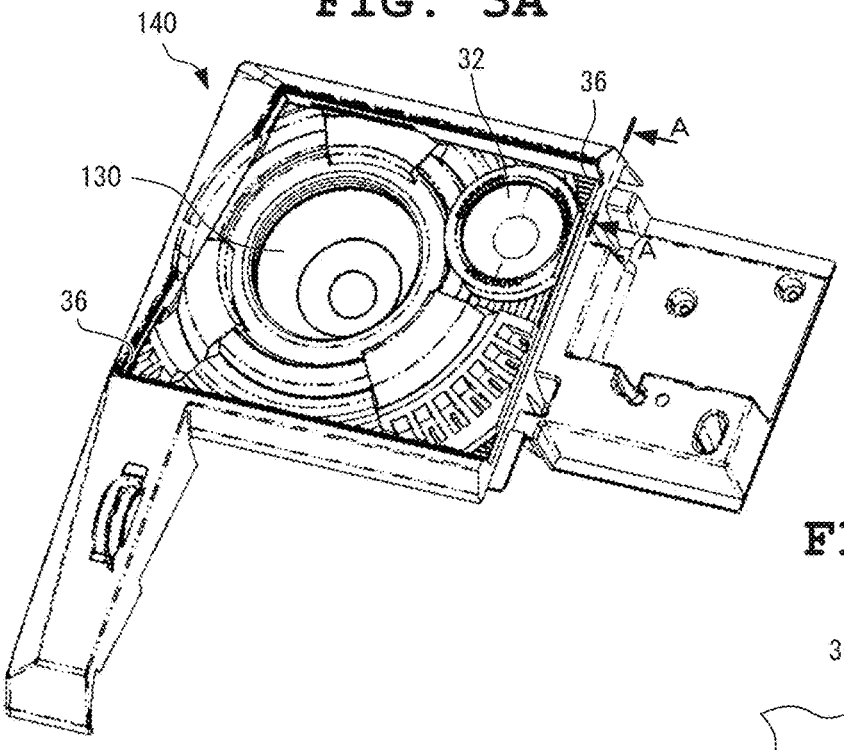
FIG. 3A to FIG. 3C are schematic diagrams showing an example of a speaker panel applied to the electronic keyboard instrument according to the embodiment.
Figure 3B:
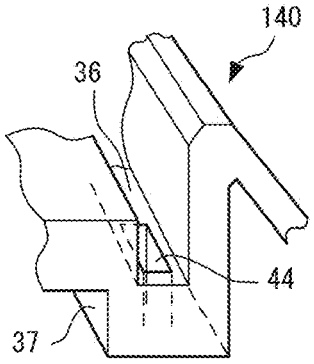
Figure 3C:
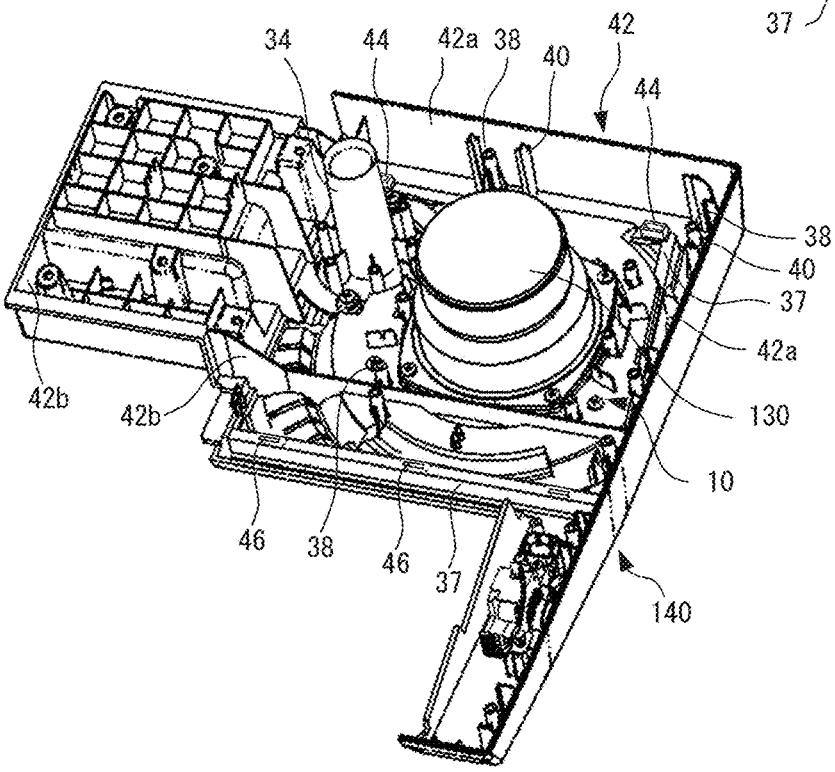
Figure 4A:
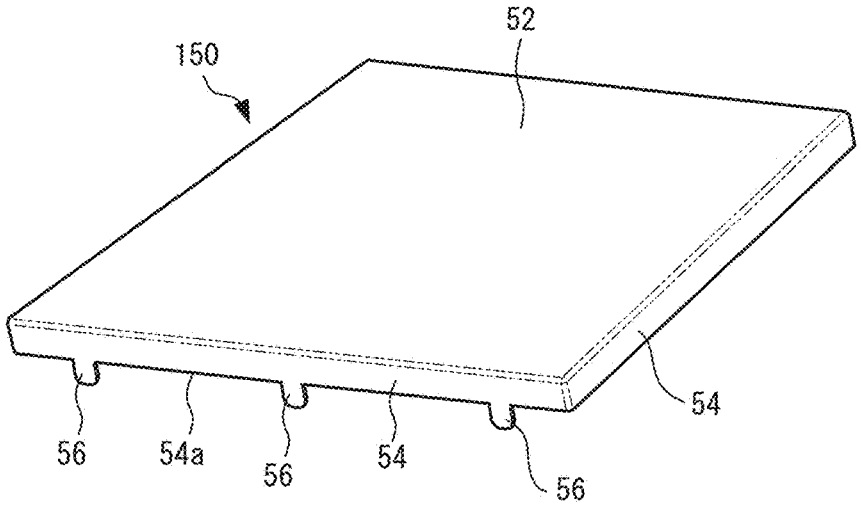
FIG. 4A and FIG. 4B are schematic diagrams showing an example of a speaker grill applied to the electronic keyboard instrument according to the embodiment.
Figure 4B:
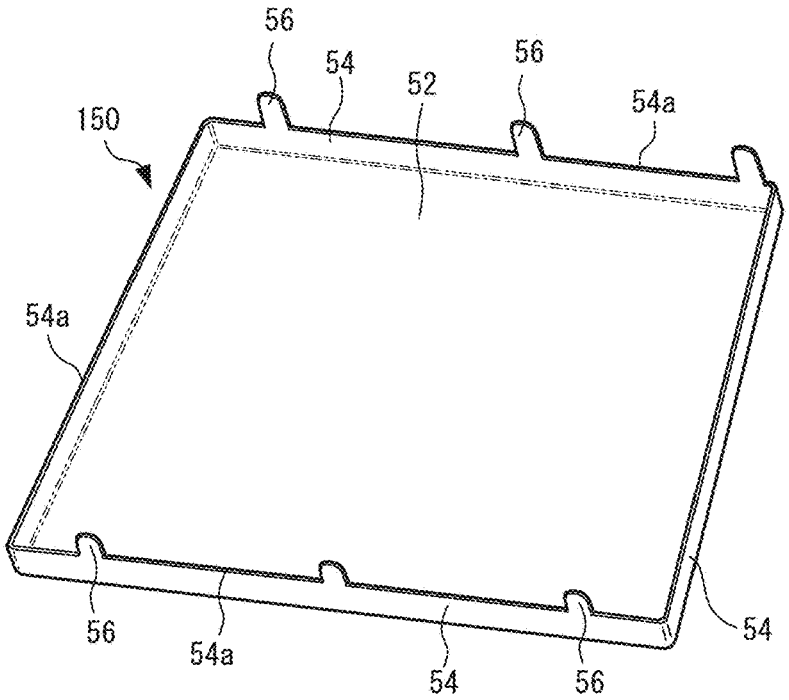
Figure 5A:
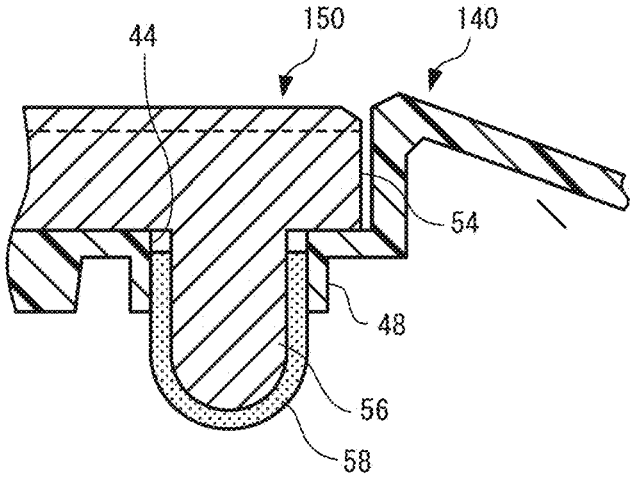
FIG. 5A to FIG. 5C are diagrams showing details of a projection section of the speaker grill applied to the electronic keyboard instrument according to the embodiment.
Figure 5B:
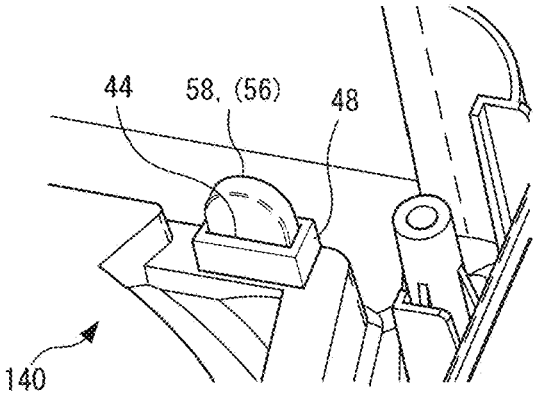
Figure 5C:
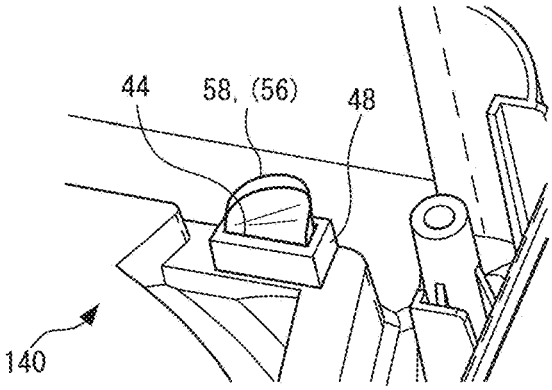
Figure 6A:
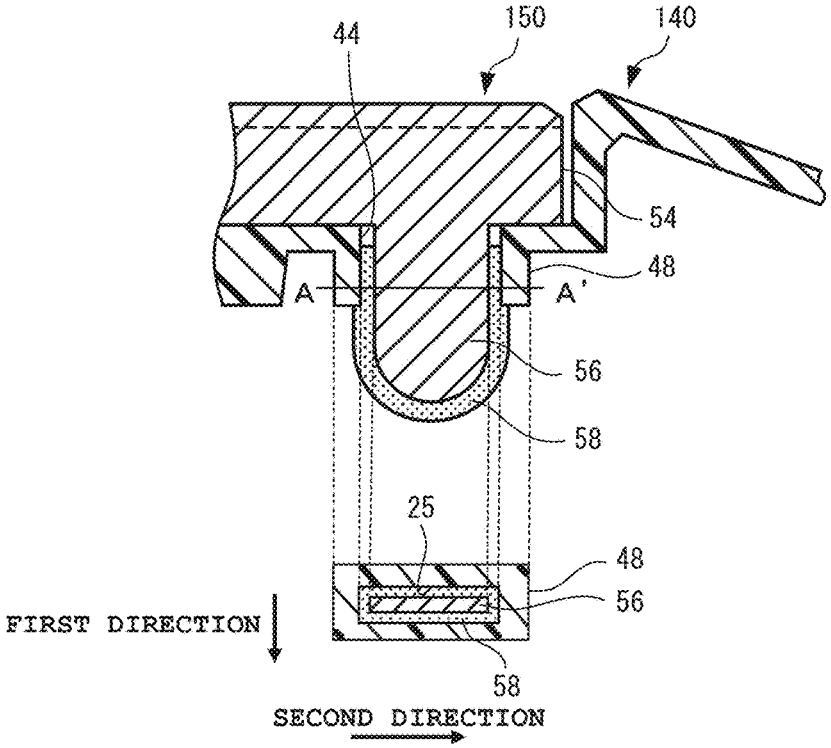
FIG. 6A and FIG. 6B are diagrams concretely describing the fixation structure of the speaker grill applied to the electronic keyboard instrument according to the embodiment.
Figure 6B:
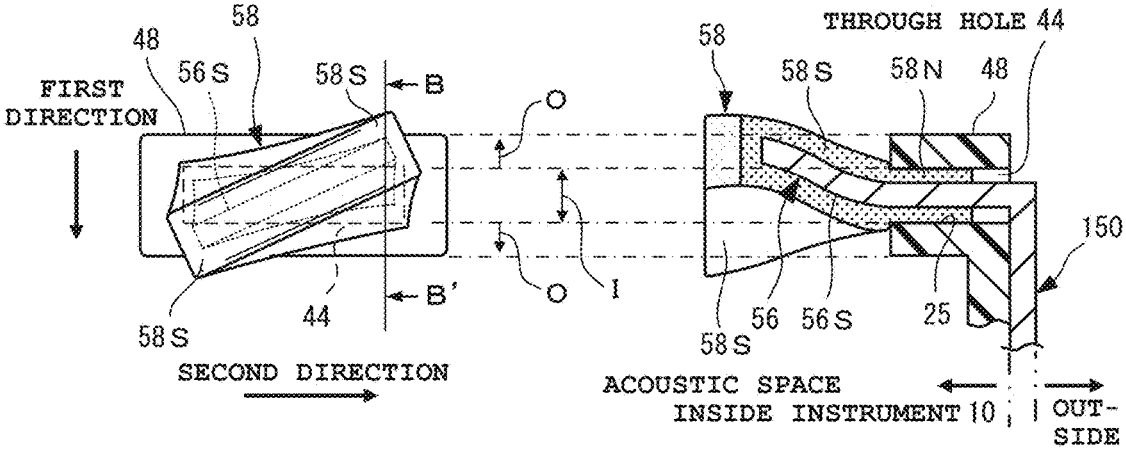
Figure 7A:
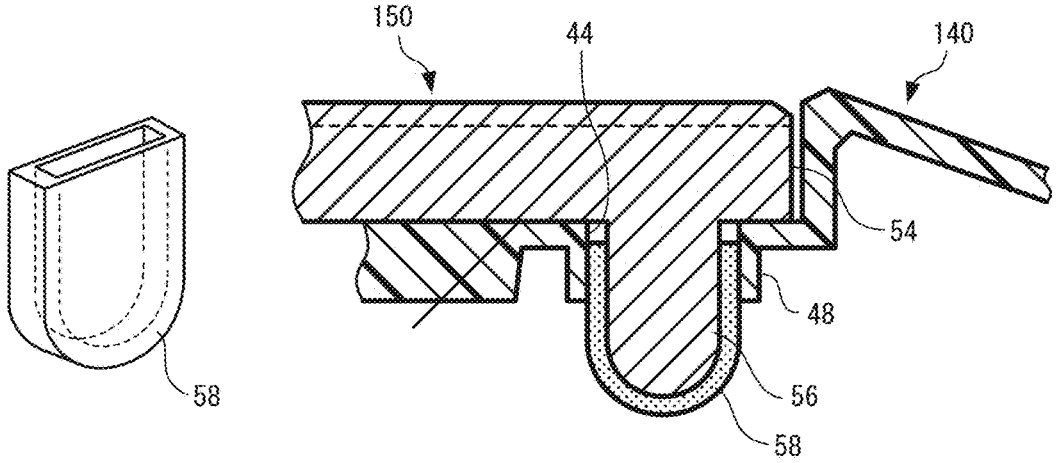
FIG. 7A to FIG. 7C are schematic diagrams showing examples of the shape of an elastic member applied to the electronic keyboard instrument according to the embodiment.
Figure 7B:
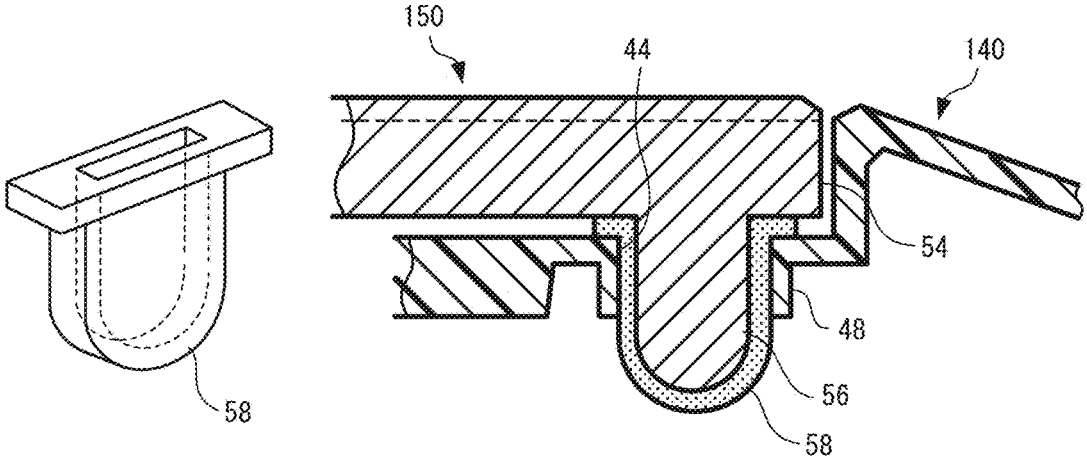
Figure 7C:
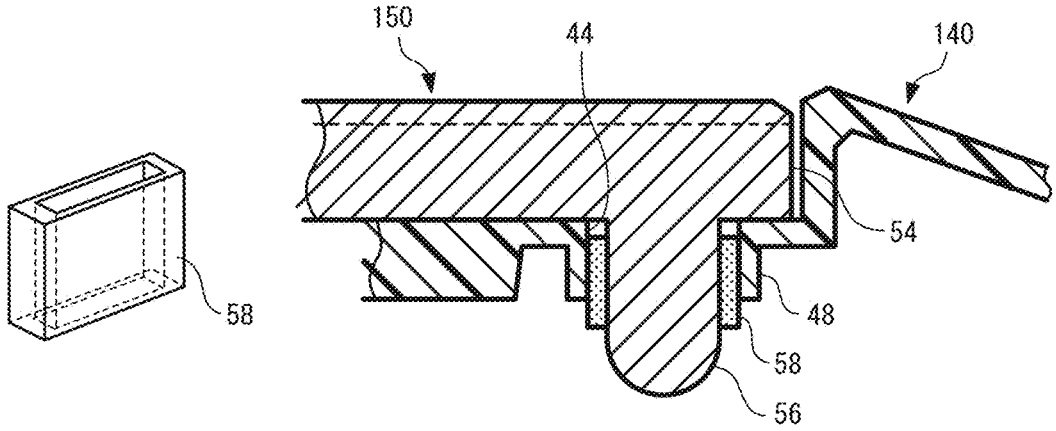

FIG. 1 is an outer appearance view of an electronic keyboard instrument serving as an embodiment of an audio device and an electronic instrument according to the present invention, and FIG. 2 is a schematic diagram showing an example of a base body case applied to the electronic keyboard instrument according to the embodiment. Also, FIG. 3A to FIG. 3C are schematic diagrams showing an example of a speaker panel applied to the electronic keyboard instrument according to the embodiment, and FIG. 4A and FIG. 4B are schematic diagrams showing an example of a speaker grill applied to the electronic keyboard instrument according to the embodiment. Moreover, FIG. 5A to FIG. 5C are diagrams showing details of a projection section of the speaker grill applied to the electronic keyboard instrument according to the embodiment, and FIG. 6A and FIG. 6B are diagrams concretely describing the fixation structure of the speaker grill applied to the electronic keyboard instrument according to the embodiment. FIG. 7A to FIG. 7C are schematic diagrams showing examples of the shape of an elastic member applied to the electronic keyboard instrument according to the embodiment.

As shown in FIG. 1, an electronic keyboard instrument 100 according to the present embodiment mainly includes a musical instrument case constituted by a base body case 120 mounted with a keyboard unit 110, speaker panels 140 mounted with speakers 130 and covered by speaker grills 150, and a center panel 160 provided with a display section 170 and an operation switch 180.

The base body case 120 has a box shape that is long in the right and left direction of the drawing, and has a structure where its upper side in the drawing is open, as shown in FIG. 2. In an area along a side surface portion (hereinafter referred to as "front side portion) of the base body case 120 on the lower side of the drawing, a keyboard mounting section 22 is provided in which a well-known keyboard unit 110 is mounted, as shown in FIG. 1. The keyboard unit 110 has white keys and black keys which are arrayed in the right and left direction of the drawing and used to specify sound pitches.

Also, in left and right end areas on a side surface portion (hereinafter referred to as "back side portion") of the base body case 120 on the upper side of the drawing, base-body-side sealed frame sections 24 that demarcate acoustic spaces 10 are provided, as shown in FIG. 2. In an area between the left and right base-body-side sealed frame sections 24 on the back side portion of the base body case 120, a battery accommodation section 26 is provided.

Each base-body-side sealed frame section 24 includes an outer-peripheral-side frame section 24*a* extending along the outer edge of the base body case 120 on its back side and its left or right side, and an inner-side frame section 24*b* extending along a boundary between the corresponding acoustic space 10 and the keyboard mounting section 22 and a boundary between the corresponding acoustic space 10 and the battery accommodation section 26 in the base body case 120, as shown in FIG. 2. By these frame sections 24*a* and 24*b*, the entire periphery of each acoustic space 10 is surrounded in the base body case 120.

On the entire peripheries of the upper ends (the open end side of the base body case 120) of the outer-peripheral-side frame section 24*a* and the inner-side frame section 24*b* of each base-body-side sealed frame section 24, a packing not shown (described later) is provided, and left and right speaker panels 140 are mounted on and come in close with the base-body-side sealed frame sections 24 via each packing. In the vicinities of the left and right base-body-side sealed frame sections 24 in the base body case 120, panel attachment bosses 28 each having a screw inserting hole for assembling and fixing the speaker panels 140 to the base body case 120 are provided.

The speaker panels 140, each of which has a speaker 130, a tweeter 32, and a bass reflex port 34 provided therein, are arranged on left and right areas of the back side portion of the base body case 120, as shown in FIG. 3A and FIG. 3C. Also, each speaker panel 140 has a shape corresponding to side portions of the base-body-side sealed frame section 24 of the base body case 120 and the keyboard unit 110, and is attached to the base body case 120. Moreover, inside each speaker panel 140, a panel-side sealed frame section 42 is provided which has a shape corresponding to the related base-body-side sealed frame section 24 of the base body case 120 and demarcates the corresponding acoustic space 10, as shown in FIG. 3C.

Each panel-side sealed frame section 42 includes an outer-peripheral-side frame section 42*a* extending along an outer edge portion on the side surface (back side portion) of the speaker panel 140 on the upper side in the drawing and an outer edge portion on the right side (or left side) of the speaker panel 140, and an inner-side frame section 42*b* extending along a boundary portion of the keyboard mounting section 22 and a boundary portion of the battery accommodation section 26 in the speaker panel 140, as shown in FIG. 3C. By these frame sections 42*a* and 42*b*, the entire periphery of the corresponding acoustic space 10 is surrounded in the corresponding speaker panel 140.

Furthermore, the outer-peripheral-side frame section 42*a* and the inner-side frame section 42*b* of each panel-side sealed frame section 42 have shapes corresponding to the shape of the upper end of the corresponding base-body-side sealed frame section 24 of the base body case 120, and the speaker panels 140 are mounted on and come in close contact with the base-body-side sealed frame sections 24 of the base body case 120 via packings (not shown). In the vicinities of the panel-side sealed frame sections 42 of the left and right speaker panels 140, panel attachment bosses 38 having screw holes are provided at positions corresponding to the positions of the plurality of panel attachment bosses 28 provided in the base body case 120. Also, in the vicinity of each panel attachment boss 38, a reinforcement rib 40 for ensuring the housing strength of the corresponding speaker panel 140 is integrally provided with, for example, the outer-peripheral-side frame section 42*a* and the inner-side frame section 42*b* of the corresponding panel-side sealed frame section 42.

Figure 13:
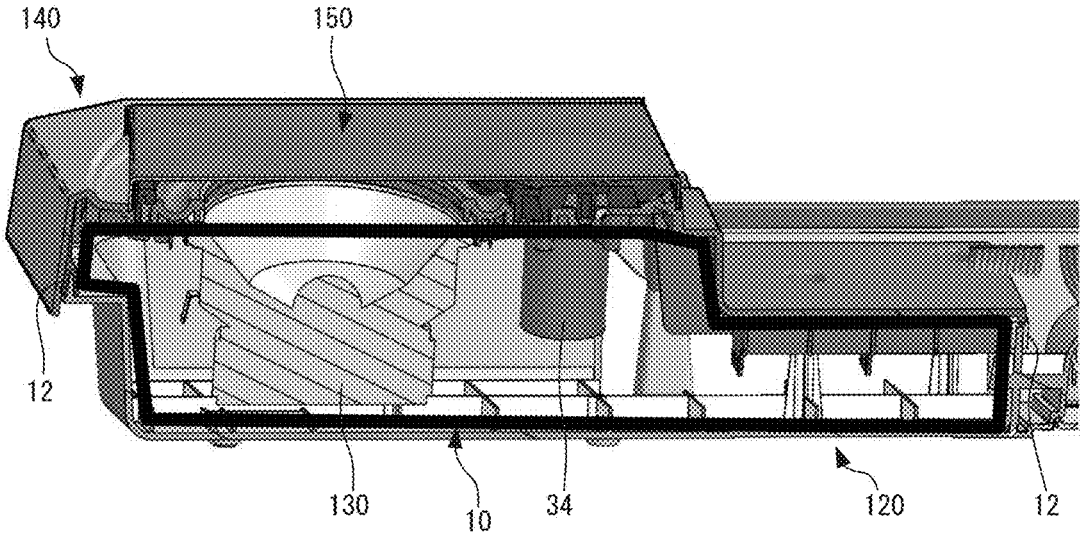
FIG. 13 is a schematic diagram showing an acoustic space demarcated in the electronic keyboard instrument according to the embodiment.

As such, the base-body-side sealed frame sections 24 of the base body case 120 and the panel-side sealed frame sections 42 of the speaker panels 140 correspond vertically, and come in close contact via the packings, whereby the sealed acoustic spaces 10 are formed in the musical instrument case including the base body case 120 and the speaker panels 140 (refer to the thick line of FIG. 13). Here, in a state where the speaker panels 140 have been mounted on the base body case 120, the plurality of panel attachment bosses 28 provided in the base body case 120 and the plurality of panel attachment bosses 38 provided in the speaker panels 140 correspond in a one-to-one relation, and the speaker panels 140 are fixed to the base body case 120 by each set of panel attachment bosses 28, 38 being fixed by a screw.

In the present embodiment, each speaker panel 140 is designed such that its outer shape is slightly larger than the base body case 120 due to the design of the product, the layout of the members to be provided inside, restrictions in the manufacturing technique and the like. That is, the speaker panels 140 outwardly project in a peaked roof shape with respect to the outer edge of the base body case 120 which is the end of the planar breadth of the base body case 120. Note that a sealing structure for an acoustic space which can be applied to the musical instrument case having the above-described structure will be described later.

The speaker grills 150 are provided on the upper surfaces of the speaker panels 140 so as to protect the sound emission surfaces of the speakers 130 and the tweeters 32 exposed from the speaker panels 140, as shown in FIG. 1. Each speaker grill 150 includes a grill main body 52 having a main surface on which a mesh-like sound hole (not shown) or the like is provided, outer peripheral sections 54 which constitute a frame shape and each of which is formed by the outer periphery of the grill main body 52 being bent in a perpendicular direction with respect to the main surface, and a plurality of projection sections 56 provided projecting in the perpendicular direction with respect to the main surface from sides (edge side sections) 54*a* that are the edges of some of the outer peripheral sections 54, as shown in FIG. 4A and FIG. 4B. The speaker grills 150 are attached and fixed to the speaker panels 140 by the projection sections 56 being inserted into attachment holes 44 and 46 provided in the speaker panels 140, and the distal ends of the projection sections 56 being deformed and held in the speaker panels 140.

Here, the attachment structure of one speaker grill 150 to the corresponding speaker panel 140 is concretely described. On the upper surface side of the speaker panel 140, linear grooves 36 are provided to which the edge side sections 54*a* of at least the outer peripheral sections 54 having the plurality of projection sections 56 among the outer peripheral sections 54 of the speaker grill 150 are fitted, as shown in FIG. 3A, FIG. 3B, FIG. 10B and the like. In the linear grooves 36, a plurality of attachment holes 44 and 46 are provided at positions corresponding to the projection sections 56 projecting from the outer peripheral sections 54 of the speaker grill 150. That is, the speaker grill 150 is a cover member and includes, at its outer periphery, the outer peripheral sections 54 and the projection sections 56 projecting from some of the outer peripheral section 54. On the other hand, the speaker panel 140 is a second housing that constitutes a case main body with the base body case 120 that is a first housing, and includes, in its inner peripheral portions, the linear grooves 36 corresponding to the shapes of the outer peripheral sections 54 of the speaker grill 150. The plurality of attachment holes 44 and 46 provided in the bottom surfaces of the linear grooves 36 penetrate to the acoustic space 10 from a space outside the main body case constituted by the base body case 120 and the speaker panel 140.

In the present embodiment, by the linear grooves 36 being provided on the upper surface side of the speaker panels 140, the thickness of each speaker panel 140 is partially thin. Accordingly, in the present embodiment, in areas where the linear grooves 36 are provided in each speaker panel 140, convex areas 37 projecting in accordance with the depths of the linear grooves 36 are provided to partially increase the thickness, whereby the strength of each speaker panel 140 is ensured, as shown in FIGS. 3B, 3C, 8B and the like. In cases where the convex areas 37 cannot be provided due to, for example, the layout of members provided inside each speaker panel 140, at least a hole rib 48 (thick thickness portion) described later should preferably be provided around each attachment hole (through hole) 44 or 46.

The attachment holes 44 and 46 provided in the linear grooves 36 are through holes penetrating through the corresponding speaker panel 140 from the upper surface (outer surface) side to the inner side, and at least some of them are provided inside each panel-side sealed frame section 42 demarcating the corresponding acoustic space 10. In an area around each attachment hole 44 or 46, the hole rib 48 is provided which has a thick portion projecting in the inserting direction (downward direction in FIG. 5A or upward direction in FIG. 5B) of the corresponding projection section 56, as shown in FIG. 3C, FIG. 5A and FIG. 5B. Alternatively, the area around each attachment hole 44 or 46 is designed to be a thick portion, as shown in FIG. 3B or FIG. 8B. These attachment holes 44 and 46 are arranged near the reinforcement ribs 40 provided near the panel attachment bosses 38 that are used when the speaker panels 140 are mounted on and fixed to the base body case 120, as shown in FIG. 8B.

Figure 10A:
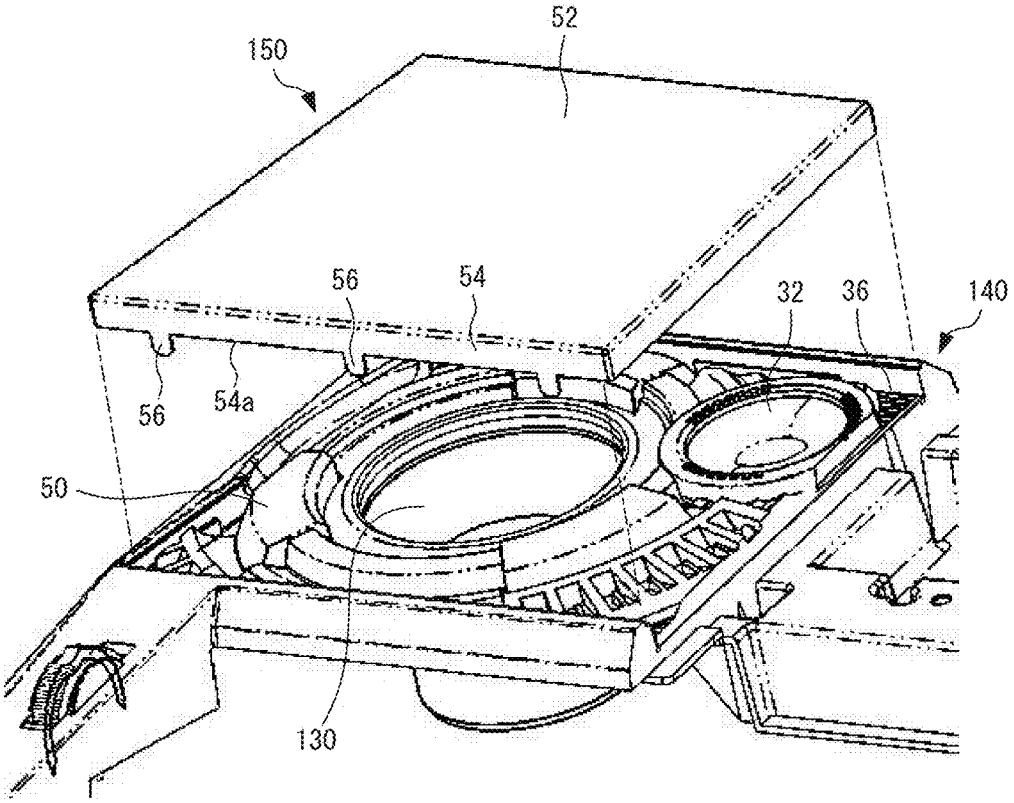
FIG. 10A and FIG. 10B are third schematic diagrams showing the example of the assembly method for the electronic keyboard instrument according to the embodiment.
Figure 10B:
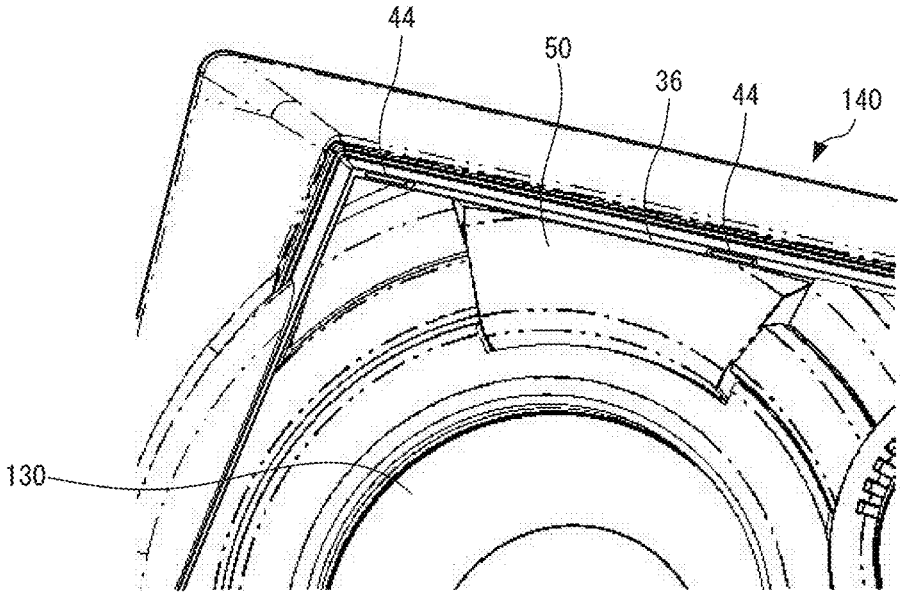

In each speaker panel 140 applied in the present embodiment, in addition to the above-described linear grooves 36, a grill accommodation section is provided on the upper surface side, in which the corresponding speaker grill 150 is entirely accommodated such that the main surface of the speaker grill 150 (grill main body 52) coincides with (flush with) the outer surface of the speaker panel 140 when the speaker grill 150 is attached, as shown in FIG. 5A, FIG. 10A, FIG. 13 and the like. In this embodiment, the linear grooves 36 are provided along the four corners and the four sides of the bottom surface of each grill accommodation section, and the plurality of attachment holes 44 and 46 corresponding to the projection sections 56 of the speaker grills 150 are provided in the linear grooves 36.

As shown in FIG. 5A, the edge side sections 54*a* of the outer peripheral sections 54 of each speaker grill 150 are fitted into the linear grooves 36 of the corresponding speaker panel 140 and the projection sections 56 of the speaker grill 150 are inserted into the attachment holes 44 and 46 of the speaker panel 140 by the speaker grill 150 being fitted into the corresponding grill accommodation section with the outer peripheral sections 54 of the speaker grill 150 being arranged along the inner surfaces of the linear grooves 36 of the speaker panel 140. In this embodiment, the attachment position (accommodation position) of each speaker grill 150 with respect to the corresponding speaker panel 140 is automatically determined by the linear grooves 36 of the speaker panel 140, and the projection sections 56 are reliably inserted to the attachment holes 44 and 46, so that the attachment work is made more efficient.

In the relation between the inner size of each attachment hole 44 or 46 provided in the speaker panels 140 and the outer size of the corresponding projection section 56, the outer size of the projection section 56 is smaller than the inner size of the attachment hole 44 or 46 so that the projection section 56 is easily inserted into the attachment hole 44 or 46 when the speaker grills 150 are attached to the speaker panels 140. Accordingly, in the state where the speaker grills 150 have been attached to the speaker panels 140, a gap is formed between each attachment hole 44 or 46 and the corresponding projection section 56.

In the present embodiment, an elastic member 58 is attached to each projection section 56 inserted into the corresponding one of the attachment holes 44 provided in the panel-side sealed frame sections 42 demarcating the acoustic spaces 10, and thereby interposed at least between the attachment hole 44 and the projection section 56, as shown in FIG. 5A and FIG. 5B. Then, the distal end of the projection section 56 exposed inside the corresponding speaker panel 140 from the attachment hole 44 having the hole rib 48 is twisted and deformed (hereinafter referred to as "torsional deformation"), so that the speaker grill 150 is fixed to the speaker panel 140 in a held state, as shown in FIG. 5C.

Here, by the projection section 56 being subjected to torsion deformation with the elastic member 58 being interposed between the attachment hole 44 and the projection section 56, the elastic member 58 is deformed inside the attachment hole 44 and comes in close contact with the surface of the projection section 56 and the inner surface of the attachment hole 44, whereby the attachment hole 44 that is a through hole is filled. That is, by the torsion deformation of the projection section 56 attached with the elastic member 58, the fixing of the speaker grill 150 and the sealing of the attachment hole 44 can be simultaneously achieved.

FIG. 6A and FIG. 6B are diagrams concretely describing the fixation structure of one speaker grill (cover member) 150 in the corresponding panel-side sealed frame section 42. In FIG. 6A, a state is shown in which one of the projection sections 56 projecting from the outer peripheral sections 54 of the speaker grill 150 have been inserted to one of the attachment holes (through hole) 44 in the hole ribs (thick portion) 48 included in the main body case, and the above-described elastic member 58 has been compressed and inserted into the attachment hole 44. As a result of this insertion, the attachment hole 44 has been filled by the elastic member 58. Note that, in the cross-section taken along A-A', the attachment hole 44 has a frame shape in which the length in the first direction is shorter than the length in the second direction. Similarly, in the cross-section taken along A-A', the projection section 56 has a frame shape where the length in the first direction is shorter than the length in the second direction, as with the shape of the attachment hole 44. In this state, the elastic member 58 falls off to the inside of the acoustic space 10 with time, so that the speaker grill 150 may be separated from the main body case. The hole rib 48 projects toward the inside.

FIG. 6B is a diagram showing a state after the distal end 568 of the projection section 56 of the speaker grill 150 and the elastic member 58 are twisted from the state of FIG. 6A. As a result, the risk that the speaker grill 150 is separated the main body case (speaker panel 140) is reduced. Here, the distal end 568 of the projection section 56 is a portion projecting from the hole rib 48 toward the acoustic space 10 in the inner area. The distal end 568 of the projection section 56 and the elastic member 58 are rotated from the state shown in FIG. 6A in the acoustic space 10. As a result, the elastic member 58 is more closely attached to the inner wall 25 of the attachment hole 44 than the state of FIG. 6A. In the state shown in FIG. 6B, the distal end 568 of the projection section 56 and a portion of the elastic member 58 are in space a located outside an extended line of the inner wall 25 of the attachment hole 44. As a result, the speaker grill 150 is fixed such that it is not outwardly separated from the main body case 120.

That is, the main body case constituted by the base body case 120 and the speaker panels 140 include inner walls 25 defining the attachment holes 44 connecting to the acoustic spaces 10 provided on the inner side. Each speaker grill 150 includes the projection sections 56 inserted into the attachment holes 44 such that the distal ends 568 project from the through holes 44 to the corresponding acoustic space side. Each elastic member 58 covers the distal end 56S of the corresponding projection section 56 and one portion 58N thereof is arranged between the inner wall 25 of the corresponding attachment hole 44 and the projection section 56 in the attachment hole 44. The other portion 58S of the elastic member 58 covering the distal end 56S of the projection section 56 and one portion of the distal end 56S are arranged in space O located outside space I surrounded by the extended line of the inner wall 25. As a result, the speaker grill 150 is fixed to the main body case 120.

The attachment holes 46 provided outside the panel-side sealed frame sections 42 have no effect on the sealability of each acoustic space 10, and therefore the projection sections 56 corresponding to these attachment holes 46 are engaged with the speaker panels 140 without elastic members by torsion deformation of the distal ends exposed from the attachment holes 44.

In the present embodiment, the linear grooves 36 are provided on the upper surface side of each speaker panel 140, and the convex areas 37 are provided inside the speaker panels 140 so as to ensure the thickness of the portions provided with the linear grooves 36. Therefore, the periphery of each attachment hole 44 or 46 where each projection section 56 of the corresponding speaker grill 150 protrudes in the corresponding speaker panel 140 projects more greatly as compared to the other members. As a result, the twisting work of each projection section 56 is facilitated, which enhances the work efficiency.

Also, in the present embodiment, the speaker grills 150 are fixed to the speaker panels 140 by torsion deformation of the projection sections 56 of the speaker grills 150 exposed from the attachment holes 44 and 46 provided in the linear grooves 36 on the upper surfaces of the speaker panels 140. As a result, the projection sections 56 to be subjected to torsion deformation and scratches on the inner side which may be made during work can be hidden from the outside, whereby high-quality design can be maintained.

Note that, as the material of the elastic members 58 of the present embodiment, a resin material such as silicon can be favorably used. Also, the shape of each elastic member 58 may be a shape by which the corresponding projection section 56 including its distal end can be entirely covered as shown in FIG. 7A, or a shape whose portion near the base of the corresponding projection section 56 projects to have a flange shape or a brim shape as shown in FIG. 7B, in addition to the shape shown in FIG. 5A and FIG. 6A. Moreover, each elastic member 58 may have a shape by which the distal end of the corresponding projection section 56 is exposed and the elastic member is positioned only inside the corresponding attachment hole 44 having the hole rib 48, as shown in FIG. 6C.

Also, the material and structure of each speaker grill 150 is required have sufficient strength to protect at least the sound emission surfaces of the corresponding speaker 130 and the corresponding tweeter 32. Accordingly, for example, a metal material such as aluminum is applied to each speaker grill 150. In addition, in the present embodiment, each speaker grill 150 should preferably be made from a material by which torsion deformation applied on the projection sections 56 when the speaker grills 150 are fixed on the speaker panels 140 can be reversibly returned to the original state or a material by which each projection section 56 can be untwisted to the extent that the projection sections 56 can be removed from the attachment holes 44 and 46 of the speaker panels 140. As a result, the speaker grills 150 attached and fixed to the speaker panels 140 can be detached, so that repair at the time of malfunction, maintenance at the time of part replacement, segregation recycle at the time of product disposal can be satisfactorily carried out. In particular, the present invention has superior effects as compared to device cases such as musical instrument cases or speaker cases where speaker grills are irreversibly attached by welding.

As such, in the present embodiment, the projection sections 56 are subjected to torsion deformation with each elastic member 58 being interposed between the corresponding attachment hole 44 provided in one of the panel-side sealed frame sections 42 demarcating the acoustic spaces 10 and the corresponding projection section 56. As a result, the elastic member 58 is deformed inside the attachment hole 44 and comes in close contact with the surface of the projection section 56 and the inner surface of the attachment hole 44, whereby the attachment hole 44 that is a through hole is filled. As a result of this structure, the speaker grills 150 can be engaged with and satisfactorily fixed to the speaker panels 140, and the leakage of sound and air from the acoustic spaces 10 and the occurrence of vibration sound (chattering sound) between each speaker panel 140 and each speaker grill 150 can be prevented. Also, since the attachment holes 44, which are used when the speaker grills 150 are attached to the speaker panels 140, can be arranged at positions where they penetrate to the acoustic spaces 10, the degree of freedom in a design related to the attachment structure of the speaker grills 150 can be enhanced, and the attachment area can be reduced, which contributes to the downsizing of the musical instrument case of an electronic keyboard instrument.

Also, in the present embodiment, the above-described hole rib 48 having a thick portion or a thick member is provided around each attachment hole 44 or 46, and the attachment holes 44 and 46 are arranged near the reinforcement ribs 40 for maintaining the housing strength of each speaker panel 140, whereby the strength with respect to stress to be applied to the attachment holes 44 and 46 and nearby portions when the projection sections 56 of the speaker grills 150 are subjected to torsion deformation can be enhanced and the breakage of the parts can be prevented. Moreover, since the inner area of each attachment hole 44 or 46 can be increased, each elastic member 58 interposed between the inner wall of the corresponding attachment hole 44 or 46 and the corresponding projection section 56 of the speaker grills 150 comes in close contact with a wide area of the inner wall of the attachment hole 44, 46, whereby the attachment hole 44 is substantially completely filled. As a result, the leakage of sound and air from the acoustic spaces 10 and the occurrence of vibration sound (chatter sound) between each speaker 140 and the corresponding speaker grill 150 can be favorably prevented.

<Assembly Method for Electronic Keyboard Instrument>

Next, an assembly method for the electronic keyboard instrument having the above-described structure is described. Here, in addition to the assembly method for the electronic keyboard instrument, the sealing structure of the acoustic space unique to the present embodiment is also described.

Figure 8A:
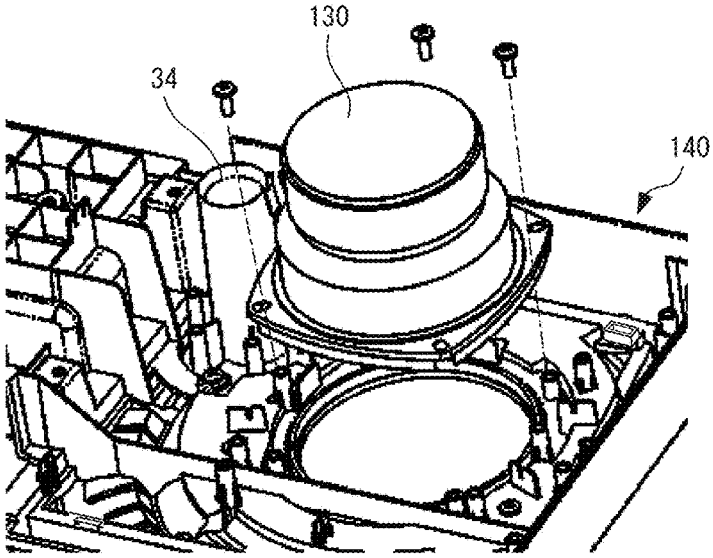
FIG. 8A and FIG. 8B are first schematic diagrams showing an example of an assembly method for the electronic keyboard instrument according to the embodiment.
Figure 8B:
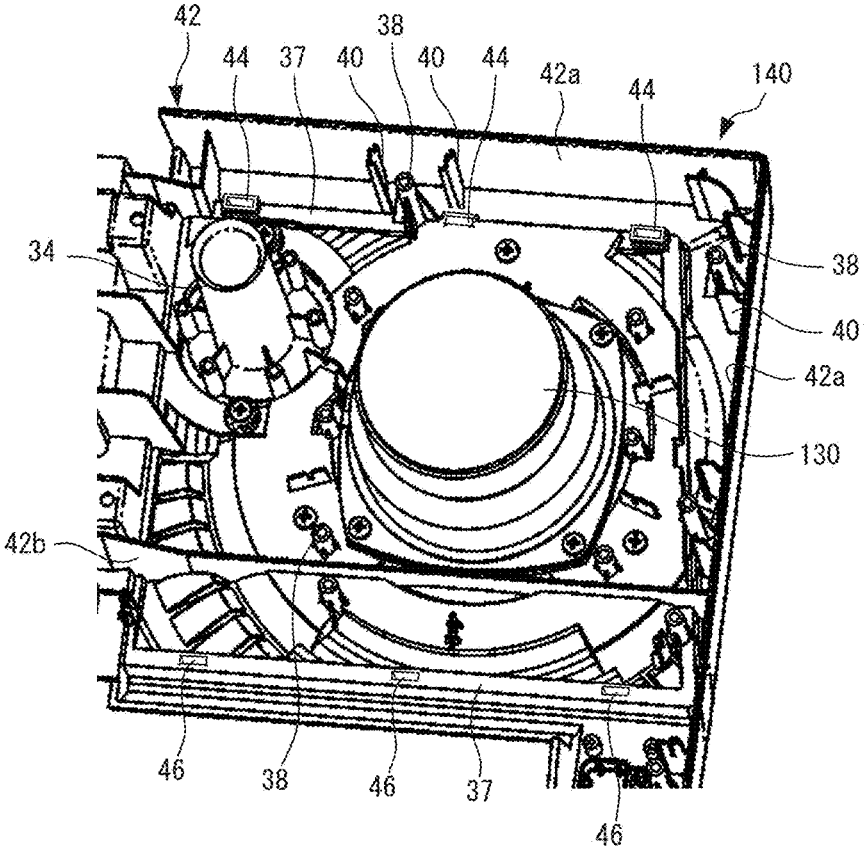
Figure 9:
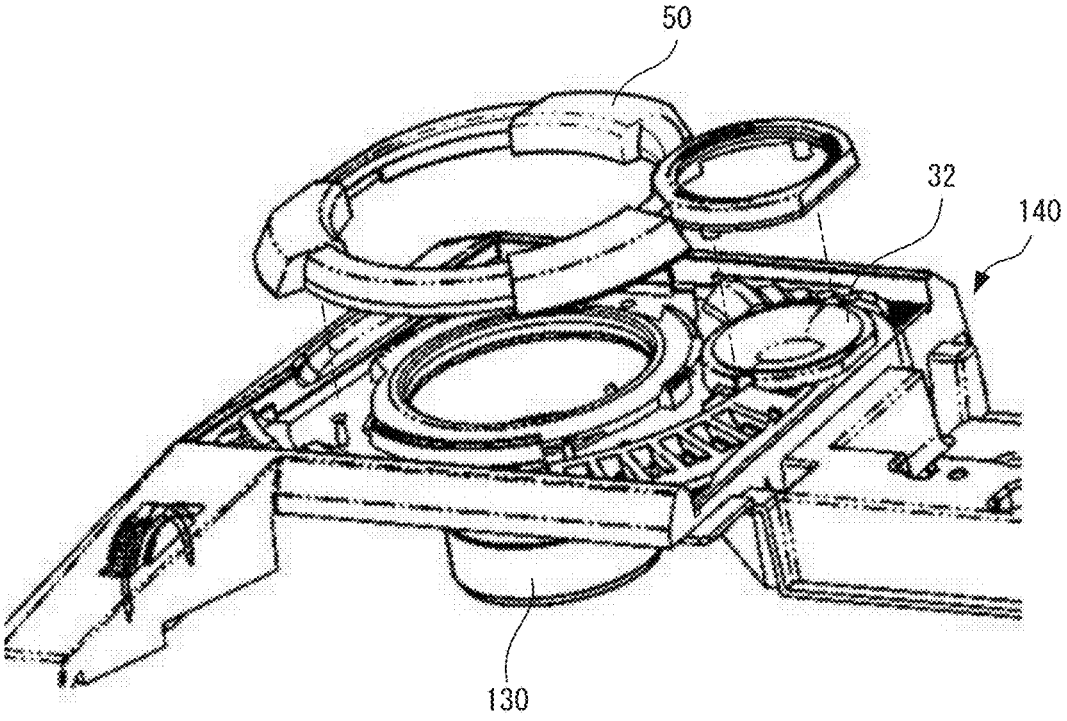
FIG. 9 is a second schematic diagram showing the example of the assembly method for the electronic keyboard instrument according to the embodiment.
Figure 11A:
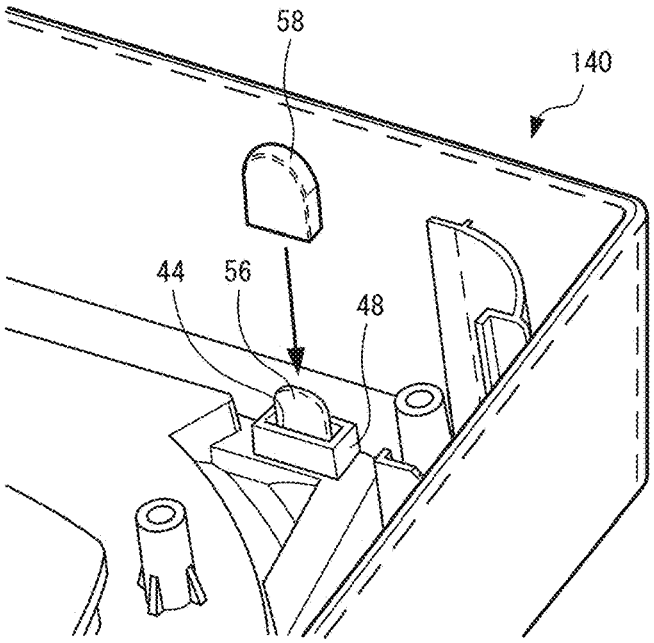
FIG. 11A and FIG. 11B are fourth schematic diagrams showing the example of the assembly method for the electronic keyboard instrument according to the embodiment.
Figure 11B:
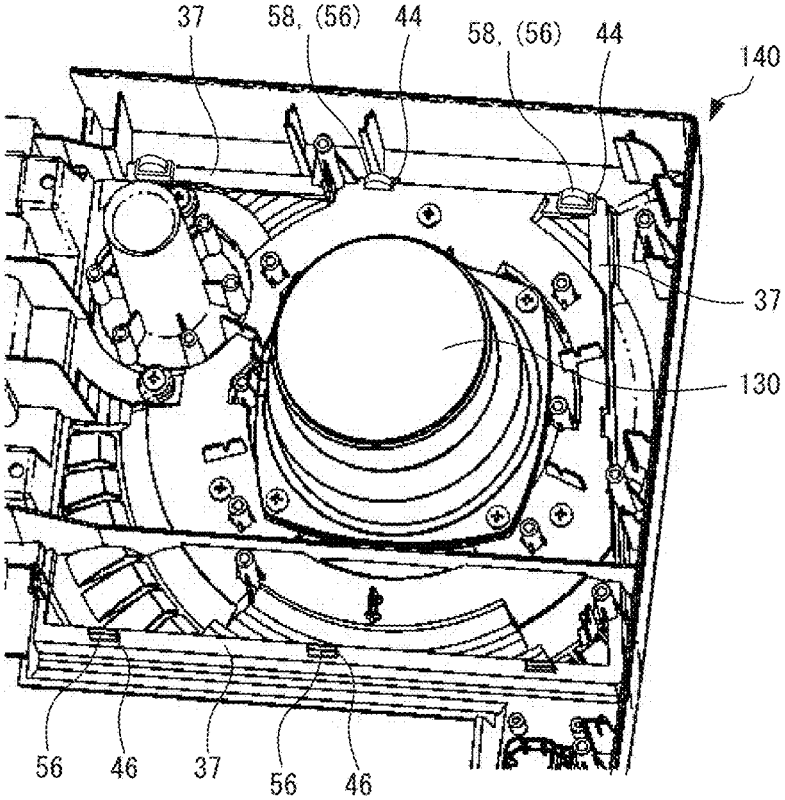
Figure 12A:
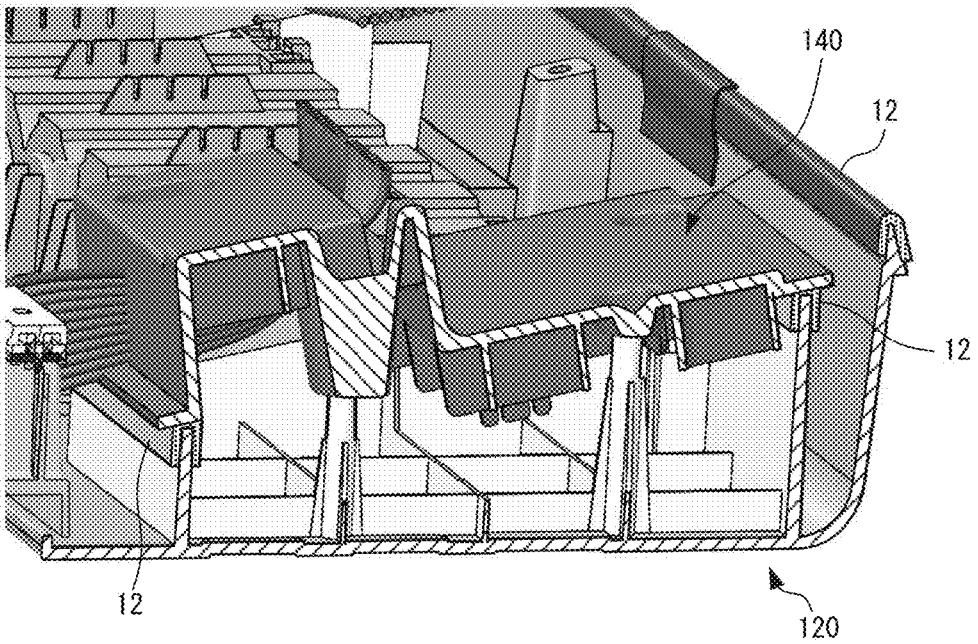
FIG. 12A and FIG. 12B are schematic diagrams showing an example of a packing applied to the base body case of the electronic keyboard instrument according to the embodiment.
Figure 12B:
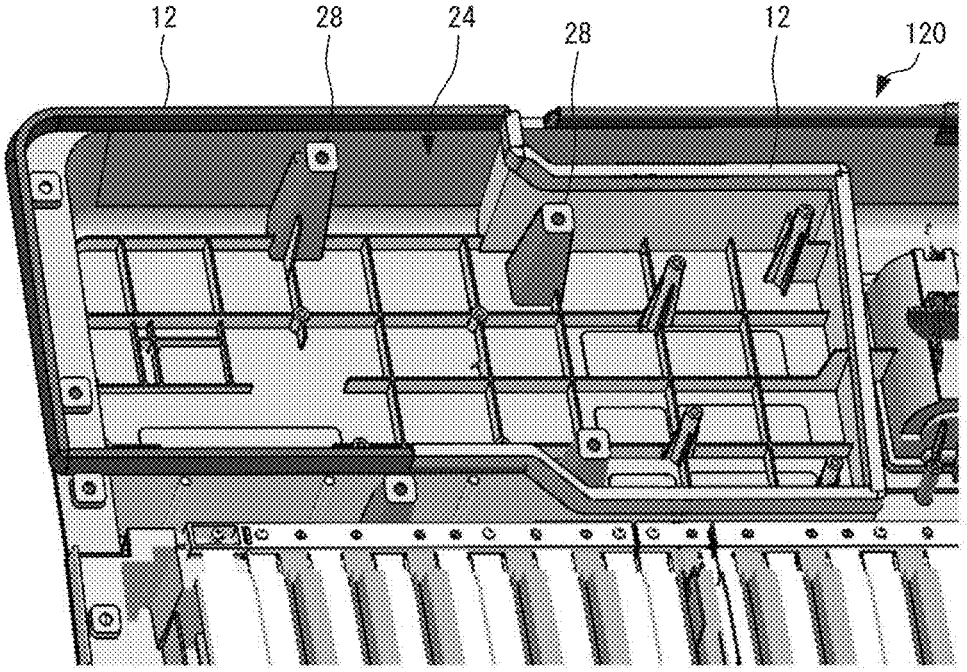
Figure 14A:
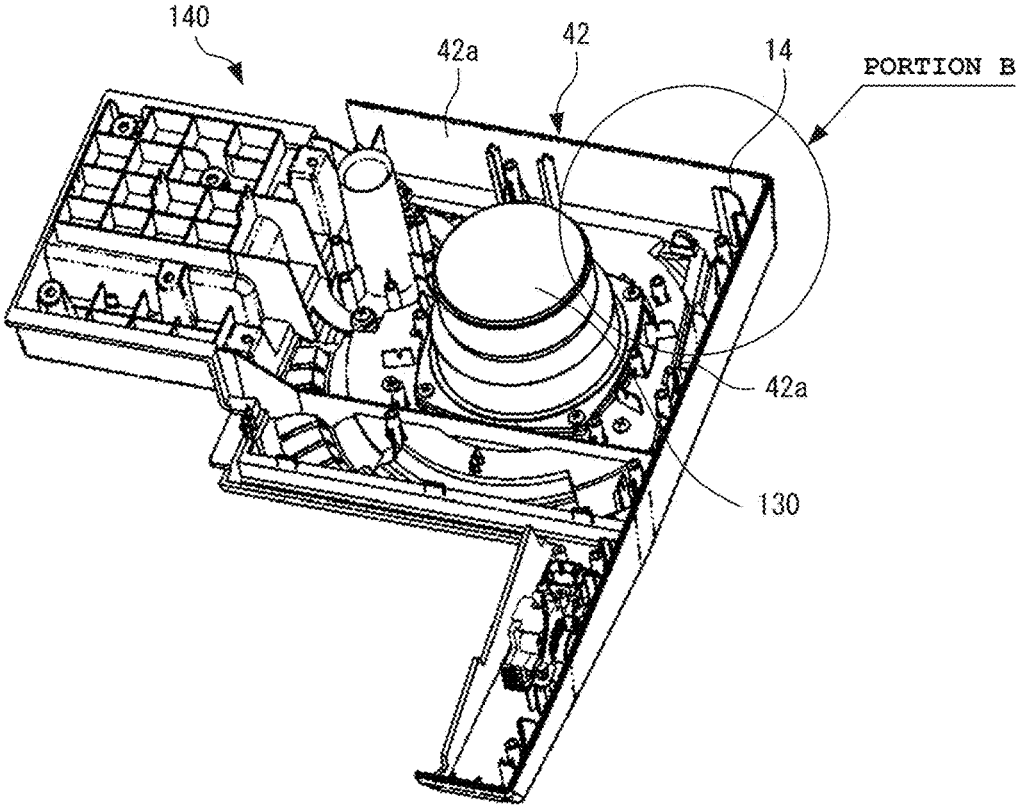
FIG. 14A and FIG. 14B are schematic diagrams showing an example of a case structure of a speaker panel of the electronic keyboard instrument according to one embodiment.
Figure 14B:
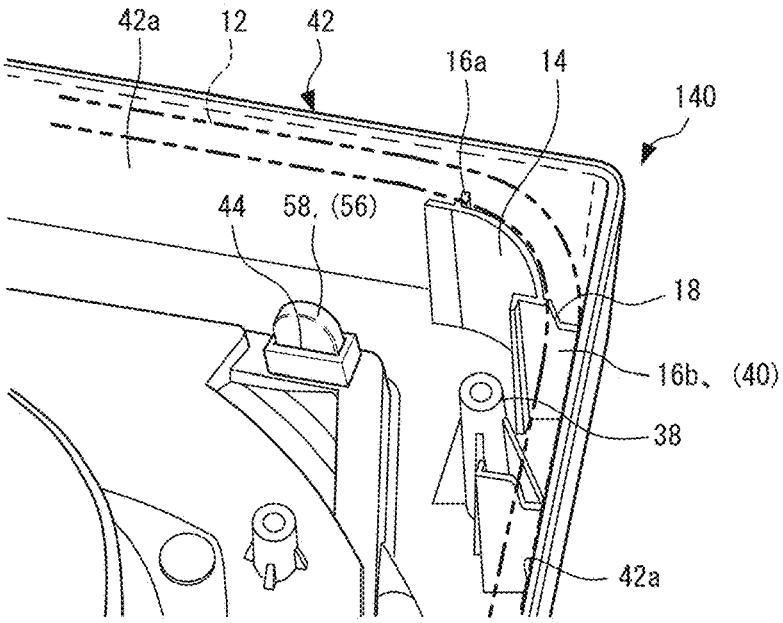
Figure 15A:
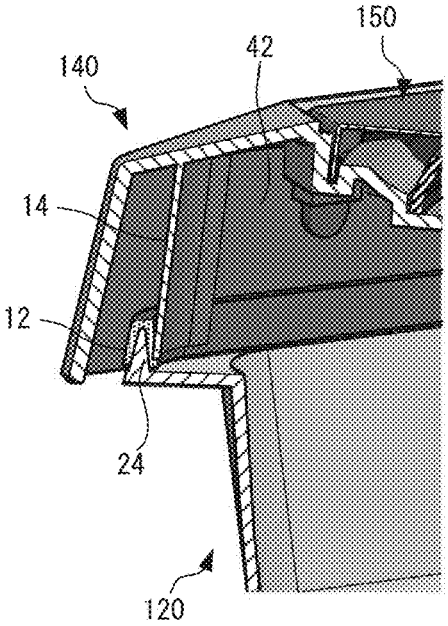
FIG. 15A to FIG. 15C are schematic diagrams showing an example of a sealing structure in an assembled state of the electronic keyboard instrument according to one embodiment.
Figure 15B:
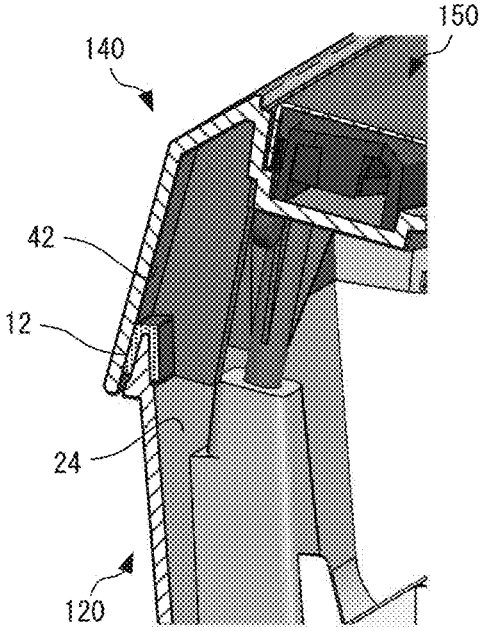
Figure 15C:
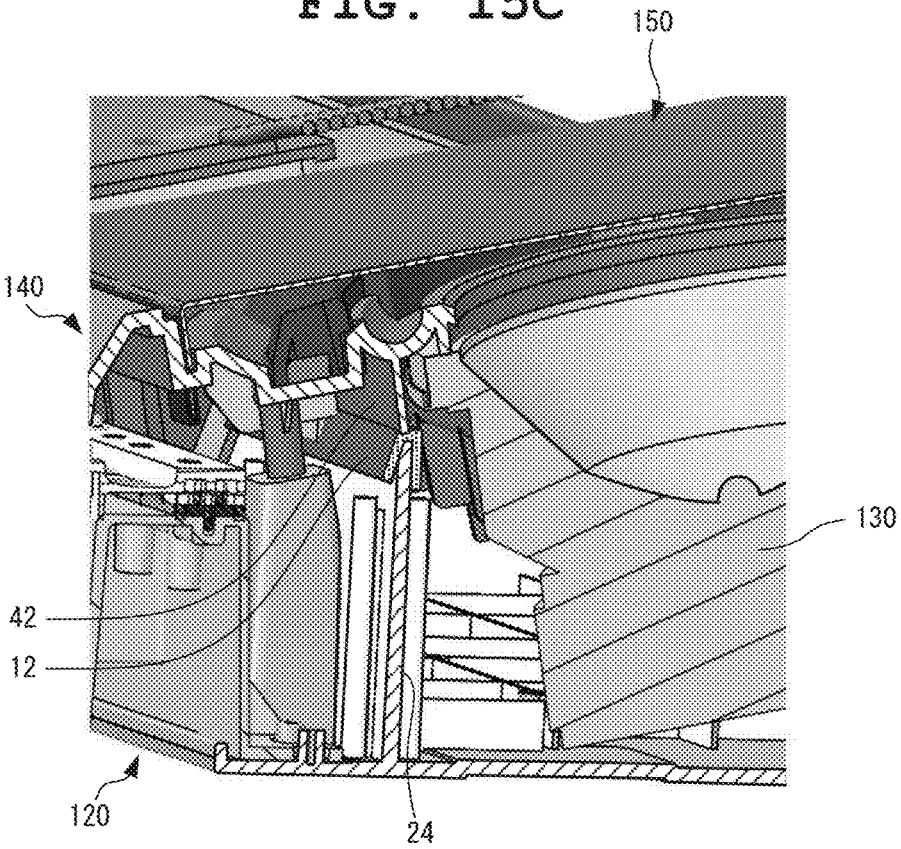

FIG. 8A to FIG. 11B are schematic diagrams showing an example of an assembly method for the electronic keyboard instrument according to the present embodiment, of which FIG. 8A, FIG. 8B and FIG. 9 are schematic diagrams showing an assembly method for mounting a speaker on a speaker panel, and FIG. 10A, FIG. 10B, FIG. 11A, and FIG. 11B are schematic diagrams showing an assembly method for mounting a speaker grill on the speaker panel. FIG. 12A and FIG. 12B are schematic diagrams showing an example of a packing applied to the base body case of the electronic keyboard instrument according to the present embodiment, and FIG. 13 is a schematic diagram showing an acoustic space defined in the electronic keyboard instrument according to the present embodiment. FIG. 14A and FIG. 14B are schematic diagrams showing an example of the case structure of the speaker panel of the electronic keyboard instrument according to the present embodiment, and FIG. 15A to FIG. 15C are schematic diagrams showing an example of a sealing structure in the assembled state of the electronic keyboard instrument according to the present embodiment.

In the assembly method for the electronic keyboard instrument according to the present embodiment, first, one of the speakers 130 is mounted on and fixed to the speaker mounting section of the corresponding speaker panel 140 by screws, as shown in FIG. 8A and FIG. 8B. Then, a speaker cover 50 is fixed by screws to the upper surface (sound emission surface side) of the speaker panel 140 to which the speaker 130 has been attached, as shown in FIG. 9.

Next, the edge side sections 54*a* of the outer peripheral sections 54 of one of the speaker grills 150 are fitted into the linear grooves 36 provided in the upper surface of the speaker panel 140, so that the attachment position of the speaker grill 150 with respect to the speaker panel 140 is determined and the projection sections 56 projecting from the outer peripheral sections 54 are inserted into the attachment holes 44 and 46 provided in the linear grooves 36, as shown in FIG. 10A and FIG. 10B. Then, the elastic members 58 are inserted and attached to the projection sections 56 exposed from the attachment holes 44 having the hole ribs 48 in the speaker panel 140 or the attachment hole 44 provided in the thick member, as shown in FIG. 11A and FIG. 11B. Here, the elastic members 58 are attached to the projection sections 56 such that each elastic member 58 is interposed between the corresponding attachment hole 44 and the corresponding projection section 56. Then, the distal ends of the projection sections 56 exposed to the inside of the speaker panel 140 are subjected to torsion deformation so as to hold and fix the speaker grill 150 on the speaker panel 140, and the elastic members 58 are deformed inside the attachment holes 44 so as to fill the attachment holes 44 that are through holes, as shown in FIG. 5C.

The speaker panels 140 where the speakers 130 and the speaker grills 150 have been mounted as described above are then attached to the left and right end areas of the back side portion of the base body case 120. Here, the panel-side sealed frame section 42 of each speaker panel 140 comes in close contact with the corresponding base-body-side sealed frame section 24 via a packing 12 provided extending on the upper end of the base-body-side sealed frame section 24 in the base body case 120, as shown in FIG. 12A and FIG. 12B. As a result, as shown in FIG. 13, each space (shown with a thick line in the drawing) surrounded by one of the base-body-side sealed frame sections 24 of the base body case 120 and the panel-side sealed frame section 42 of one of the speaker panels 140 is sealed and demarcated as an acoustic space 10.

In the case of an acoustic space demarcated as described above, even when an attachment hole of a speaker grill is provided penetrating to the acoustic space, the attachment hole can be filled by an elastic member. Therefore, the leakage of sound and air from the acoustic space and the occurrence of vibration sound (chatter sound) can be prevented, whereby the sealability can be ensured. Accordingly, sound waves emitted from a speaker provided in a speaker panel can be favorably echoed in the sealed acoustic space, which improves the sound quality. Also, the attachment area of the speaker grill can be reduced, which contributes to the downsizing of the musical instrument case of an electronic keyboard instrument.

In the above-described assembly method for the electronic keyboard instrument, the projection sections 56 of the speaker grills 150 are inserted into the attachment holes 44 of the speaker panels 140, and then the elastic members 58 are attached to the projection sections 56 and subjected to torsion deformation. However, the present invention is not limited thereto. That is, it is only required that each elastic member 58 is between the corresponding attachment hole 44 and the corresponding projection section 56 at timing at which the projection sections 56 of the speaker grills 150 are inserted into the attachment holes 44 of the speaker panels 140 (timing immediately before torsion deformation). Accordingly, a method may be adopted in which, after the elastic members 58 shown in FIG. 7A or FIG. 7C are attached to the projection sections 56 of the speaker grills 150, the projection sections 56 in this state are inserted into the attachment holes 44 of the speaker panels 140, and the distal ends thereof are subjected to torsion deformation. Also, a method may be adopted in which the elastic members 58 each of which has a shape whose base portion projects to have a flange shape or a brim shape as shown in FIG. 7B are inserted into the attachment holes 44 of the speaker panels 140, and then the projection sections 56 of the speaker grills 150 are inserted into the attachment holes 44 (in the elastic members 58).

<Specific Example of Sealing Structure>

Next, a specific example of the sealing structure of the acoustic space applied to the electronic keyboard instrument described above is described.

FIG. 14A and FIG. 14B are schematic diagrams showing a main portion of the speaker panel applied to the electronic keyboard instrument according to the present embodiment, and FIG. 15A to FIG. 15C are schematic diagrams showing a main portion of the sealing structure applied to the electronic keyboard instrument according to the present embodiment.

As described above, in the sealing structure in the present embodiment, the panel-side sealed frame sections 42 in the speaker panels 140 come in close contact with the packing 12 provided extending on the upper ends of the base-body-side sealed frame sections 24 in the base body case 120 as shown in FIG. 12B, so that each space surrounded by the corresponding base-body-side sealed frame section 24 of the base body case 120 and the panel-side sealed frame section 42 of the corresponding speaker panel 140 is sealed and demarcated as an acoustic space 10, as shown in FIG. 13.

In cases where the panel-side sealed frame sections 42 have shapes by which they evenly come in close contact with the packing 12 provided on the upper ends of the base-body-side sealed frame sections 24, the sealability of each acoustic space 10 is sufficiently ensured. However, there is a case where the panel-side sealed frame sections 42 having the shapes by which they favorably come in close contact with the packing 12 on the upper ends of the base-body-side sealed frame sections 24 are not actualized due to, for example, the design of the product, the layout of the members provided inside, restrictions in the metallic molding technique and the like. The present embodiment applies to this case and has the structure where the speaker panels 140 are designed to be slightly larger than the outer shape of the base body case 120 and, in a state where the speaker panels 140 have been mounted on the base body case 120, each speaker panel 140 projects outward in a peaked roof shape with respect to the outer edge of the base body case 120 such that it especially projects at case corners.

Accordingly, in the present embodiment, a corner rib 14 is provided near a corner (details of portion B) of the outer-peripheral-side frame section 42*a* of the panel-side sealed frame section 42 of each speaker panel 140, as shown in FIG. 14A and FIG. 14B. This corner rib 14 is independently projected from the bottom surface of the speaker panel 140 (the speaker attachment surface or the opposite surface of the speaker grill attachment surface) on the lower side in the drawing toward the upper side in the drawing (open end direction), in substantially parallel to the outer-peripheral-side frame section 42*a*, The planar shape of the corner rib 14 when viewed from the upper side in the drawing is an arc-like shape or a gradually curved shape. On the other hand, the corresponding corner of the outer-peripheral-side frame section 42*a* has a planar shape that is bent at a substantially right angle.

The corner rib 14 includes reinforcement ribs 16*a* and 16*b* for enhancing the structural strength, which are provided on both ends of its arc-like planar shape and connected at a substantially right angle to the outer-peripheral-side frame section 42*a*, as shown in FIG. 14B. In a case where the speaker panels 140 are formed by resin molding, the corner rib 14 and the reinforcement ribs 16*a* and 16*b* are integrally formed with another portion such as the outer-peripheral-side frame section 42*a* and the bottom surface.

Also, in the upper parts of the reinforcement ribs 16*a* and 16*b* on the outer peripheral surface (surface opposing the outer-peripheral-side frame section 42*a*) side of the corner rib 14, notched sections 18 for holding the corresponding packing 12 or coming in close contact with the outer periphery of the packing 12 are provided, as shown in FIG. 14B.

Note that, in the structure of FIG. 14B, the reinforcement rib 16*b* also serves as a reinforcement rib 40 near the panel attachment boss 38 provided in the vicinity of the corner of the outer-peripheral-side frame section 42*a*. Also, the reinforcement ribs 16*a* and 16*b* are not required to have the structures where they connect the corner rib 14 and the outer-peripheral-side frame section 42*a*, and may have other structures. For example, the reinforcement rib 16*b* may have a structure where it is provided near the corner rib 14 regardless of the position of the panel attachment boss 38.

In the electronic keyboard instrument having the above-described structure, when the speaker panels 140 are attached to the base body case 120 as in the assembly method described above, the outer peripheral surfaces of the corner ribs 14 come in close contact with the packing 12 provided on the upper ends of the base-body-side sealed frame sections 24 in the base body case 120, at the corners of the panel-side sealed frame sections 42 where the corner ribs 14 are provided, as shown in FIG. 15A. That is, at these corners of the speaker panels 140, the outer peripheral surfaces of the corner ribs 14 come in close contact with the inner surfaces of the base-body-side sealed frame sections 24 in the base body case 120 via the packing 12.

At linear portions of each panel-side sealed frame section 42 other than the above-described corners, the inner surface of the panel-side sealed frame section 42 comes in close contact with the packing 12 of the corresponding base-body-side sealed frame section 24, as shown in FIG. 15B. Also, as shown in FIG. 15C, the end (lower end in the drawing) of each panel-side sealed frame section 42 comes in close contact with the packing 12 of the corresponding base-body-side sealed frame section 24. That is, in portions of the speaker panels 140 other than the above-described corners (where the corner ribs 14 are provided), the inner surfaces of the panel-side sealed frame sections 42 of the speaker panels 140 come in close contact with the outer surfaces of the base-body-side sealed frame sections 24 in the base body case 120 via the packing 12. Also, the lower ends of the panel-side sealed frame sections 42 of the speaker panels 140 come in close contact with the upper ends of the base-body-side sealed frame sections 24 via the packing 12.

As such, in the state where the speaker panels 140 have been mounted on the base body case 120, in all the attachment areas, the corner ribs 14 or the panel-side sealed frame sections 42 of the speaker panels 140 and the base-body-side sealed frame sections 24 of the base body case 120 come in close contact via the packing 12. Thus, in the present embodiment, the leakage of sound and air of the acoustic space 10 can be prevented and the sealability can be ensured. Also, by the reinforcement ribs being provided integrally with or near the corner ribs 14, the structural strength can be enhanced and the sealability of the acoustic space 10 can be further enhanced.

In the above-described embodiment, the electronic keyboard instrument (electronic keyboard) has been described as an example of an audio device equipped with a device case according to the present invention. However, the present invention is not limited thereto, and can be applied to a stand-alone speaker, audio equipment and the like other than the electronic instrument.

While the present invention has been described with reference to the preferred embodiments, it is intended that the invention be not limited by any of the details of the description therein but includes all the embodiments which fall within the scope of the appended claims.

What is claimed is:

1. An audio device comprising:

a main body case having an inner wall defining a through hole connected to an acoustic space formed around at least one speaker provided inside the main body case;

a cover member having a projection section inserted into the through hole such that a distal end of the projection section projects into the acoustic space via the through hole; and an elastic member which covers the distal end of the projection section, at least one portion of the elastic member being arranged between the inner wall and the projection section in the through hole, wherein at least one portion of the elastic member covering the distal end and at least one portion of the distal end are arranged in a space located outside a space surrounded by an extended line of the inner wall, whereby the cover member is fixed to the main body case.

2. The audio device according to claim 1, wherein the main body case has a thick portion which is provided around the through hole and projects to the acoustic space.

3. The audio device according to claim 1, wherein the projection section is provided on an outer periphery of the cover member, wherein the main body case further has a groove having a shape corresponding to a shape of the outer periphery, the groove being provided in an inner peripheral portion of the main body case, and wherein the through hole is provided in a bottom surface of the groove and penetrates from an area outside the main body case to the acoustic space.

4. The audio device according to claim 1, wherein the main body case has a sound emission section provided therein, and wherein the acoustic space is a space where a sound wave emitted from the sound emission section is echoed.

5. The audio device according to claim 1, wherein the main body case includes a first housing an inner corner of which has a first shape, and a second housing including a corner rib member provided at an inner corner thereof and having a shape corresponding to the first shape, and wherein the acoustic space is defined inside the main body case with respect to the corner rib member by the inner corner of the first housing contacting with an outer side of the corner rib member of the second housing.

6. The audio device according to claim 5, wherein the main body case has a second elastic member provided extending along a boundary of the acoustic space so as to contact with the first housing and the second housing.

7. An electronic instrument comprising:

operators for specifying pitches;

a main body case having an inner wall defining a through hole connected to an acoustic space which is formed around at least one speaker provided inside the main body case and in which a sound emitted from a sound emission section in response to operation of at least one of the operators is echoed;

a cover member having a projection section inserted into the through hole such that a distal end of the projection section projects into the acoustic space via the through hole; and an elastic member which covers the distal end of the projection section, at least one portion of the elastic member being arranged between the inner wall and the projection section in the through hole, wherein at least one portion of the elastic member covering the distal end and at least one portion of the distal end are arranged in a space located outside a space surrounded by an extended line of the inner wall, whereby the cover member is fixed to the main body case.

8. The electronic instrument according to claim 7, wherein the main body case has a thick portion which is provided around the through hole and projects to the acoustic space.

9. The electronic instrument according to claim 7, wherein the projection section is provided on an outer periphery of the cover member, wherein the main body case further has a groove having a shape corresponding to a shape of the outer periphery, the groove being provided in an inner peripheral portion of the main body case, and wherein the through hole is provided in a bottom surface of the groove and penetrates from an area outside the main body case to the acoustic space.

10. The electronic instrument according to claim 7, wherein the main body case has the sound emission section provided therein, and wherein the acoustic space is a space where a sound wave emitted from the sound emission section is echoed.

11. The electronic instrument according to claim 7, wherein the main body case includes a first housing an inner corner of which has a first shape, and a second housing including a corner rib member provided at an inner corner thereof and having a shape corresponding to the first shape, and wherein the acoustic space is defined inside the main body case with respect to the corner rib member by the inner corner of the first housing contacting with an outer side of the corner rib member of the second housing.

12. The electronic instrument according to claim 11, wherein the main body case has a second elastic member provided extending along a boundary of the acoustic space so as to contact with the first housing and the second housing.

* * * * *